United States Patent [19]

Sawafuji

[11] 4,276,449

[45] Jun. 30, 1981

[54] SPEAKER OR MICROPHONE HAVING CORRUGATED DIAPHRAGM WITH CONDUCTORS THEREON

[76] Inventor: Tadashi Sawafuji, No. 9-15 Nishi-Sugamo 1-chome, Toshima-ku, Tokyo, Japan

[21] Appl. No.: 43,636

[22] Filed: May 30, 1979

[30] Foreign Application Priority Data

| | | | |
|---|---|---|---|
| Jun. 1, 1978 | [JP] | Japan | 53/66198 |
| Jul. 21, 1978 | [JP] | Japan | 53/99611[U] |
| Sep. 14, 1978 | [JP] | Japan | 53/112962 |

[51] Int. Cl.[3] ..... H04R 7/14; H04R 7/18; H04R 9/04

[52] U.S. Cl. ..... 179/115.5 PV; 179/115.5 ES

[58] Field of Search ..... 179/115.5 PV, 115.5 VC, 179/115.5 ES, 115.5 R

[56] References Cited

U.S. PATENT DOCUMENTS

| | | | |
|---|---|---|---|
| 2,439,666 | 4/1948 | Marquis | 179/115.5 ES X |
| 3,164,686 | 1/1965 | Tibbetts | 179/115.5 PV |

FOREIGN PATENT DOCUMENTS

| | | | |
|---|---|---|---|
| 1098541 | 2/1961 | Fed. Rep. of Germany | 179/115.5 PV |
| 2063662 | 7/1971 | Fed. Rep. of Germany | 179/115.5 PV |
| 1443491 | 7/1976 | United Kingdom | 179/115.5 PV |

*Primary Examiner*—Thomas W. Brown

*Attorney, Agent, or Firm*—Burgess, Ryan and Wayne

[57] ABSTRACT

A thin film member formed of a synthetic resin material, a paper material or a non-magnetic metal foil material is provided on its both surfaces with conductors. The thin film member is then corrugated, as by folding, to form a number of elongate, arcuate corrugations which serve as a diaphragm. Rod-like permanent magnets extending perpendicularly to the conductors on each trough in the corrugations and generating magnetic flux in the same direction are retained over substantially the entire length between adjacent trough portions. The diaphragm is supported on both surfaces of each side edge thereof by support members which are expandable and contractable only in the direction extending perpendicularly to the diaphragm.

14 Claims, 13 Drawing Figures

SPEAKER OR MICROPHONE HAVING CORRUGATED DIAPHRAGM WITH CONDUCTORS THEREON

BACKGROUND OF THE INVENTION

The present invention relates to improved acoustic transducers having a diaphragm of the type where the entire surface is driven, which are designed for use in loudspeakers, earphones, head phones or microphones.

For example, in U.S. Pat. No. 3,919,498 specification there is described an acoustic transducer having a conductor and a vibratable flat diaphragm disposed in a magnetic field defined by a permanent magnet. The transducer of this type has the flat diaphragm fixed to the confronting magnet at its entire periphery and its center by means of a suitable fixing member. This transducer has a disadvantage in that since the entire surface of the diaphragm is not driven, the amplitude of the diaphragm is so small that a low sound frequency range cannot faithfully be reproduced. There is also known an acoustic transducer having a corrugated diaphragm having a number of elongate, rectangular sections. A disadvantage of the transducer of this type is that the diaphragm does not vibrate as a unit while undergoing partial deformation, resulting in unfaithful sound reproduction. This is because the central portions of the flat portions forming part of the corrugated diaphragm are expanded and deformed in the direction opposite to vibrations due to air resistance and inertia, and that the thus expanded and deformed portions are subjected to restoration by decreases in the air resistance and the elasticity of the flat portions at the lower and upper limits of vibrations.

A main object of the present invention is therefore to provide an acoustic transducer free from such disadvantages.

In accordance with the present invention, the diaphragm comprises a thin film member corrugated to form a number of elongate, arcuate corrugations and conductors provided on the respective trough portions of the corrugations in series relation thereto. Permanent magnets adapted to produce magnetic fluxes in the direction extending perpendicularly to the conductors on the respective trough portions are retained between the respective trough portions, and both surfaces of each side edge portions of the diaphragm are carried by support members which are expandable and contractable only in the direction normal to the diaphragm. With such an arrangement, it is possible to prevent the diaphragm from suffering any deformation due to the air pressure caused by its vibrations and inertia. In addition, even when the diaphragm is partially deformed, no restoration of the thus deformed portion takes place at the end of vibrations. The expandability and restorability of the support members make it possible to increase the amplitude of the travel of the diaphragm and to uniformly oscillate the diaphragm over its entire surface and in the same phase, thus leading to faithful reproduction of a low sound range and increases in the allowable input.

The above and other objects and advantages will be clear from the following detailed description of exemplary preferred embodiments illustrated in the appended drawing.

BRIEF DESCRIPTION OF THE DRAWING

Referring now to FIG. 1, there is shown a partially cut away expansion plan of a rectangular diaphragm designed for use in the loudspeaker which is one embodiment of the acoustic transducer according to the present invention. The diaphragm illustrated comprises a rectangular, thin film member 1 formed of a synthetic resin material such as polyester, polyethylene, polypropylene or nylon having a thickness on the order of 10 to 100 microns, which resin material is less affected by room temperature, a paper material for diaphragms or a non-magnetic metal foil material sush as titanium or aluminium having a thickness on the order of 10 to 100 microns and having an insulating layer applied on the surface on which conductors will be provided as described hereinafter. This thin film member 1 is formed into a given shape after it has been provided on both major surfaces thereof with conductors made of meandering wire gauges. More specifically, a continuous, meandering wire gauge conductor 5 is formed on portion 3' and 4' of the surface of the thin film member 1 which will respectively provide peak portions 3 and trough portions 4 in the arcuate corrugations 2 upon shaping of the thin film member 1, and a similar conductor 6 is formed on the rear surface thereof in a different pitch phase. A terminal **5*b* of an extreme conductor 5*a* on portion 3' which will provide a peak portion in the arcuate corrugation 2 is electrically connected by an eyelet or other suitable means 7 with a terminal 6*b* of an extreme conductor 6*a* on portion 4' which will provide a trough portion in the arcuate corrugation 2, whereby the conductor 5 is connected in series with the conductor 6. Such a thin film member is corrugated as by folding to form a number of elongate, arcuate corrugations 2 which serve as a diaphragm 8. Sound currents flow through the conductors 5, 6 on the respective trough portions 4 of diaphragm 8 in the same direction while flowing through the conductors 5, 6 on the respective peak portions 3 thereof in the opposite direction, but the conductors are not affected by the magnetic fluxes caused by the permanent magnets as described hereinafter. Reference numerals 9 and 10 are lead wires. The conductors 5 and 6 are provided by known means including printing and deposition. Only one of the conductors 5 and 6 may be applied on the thin film member 1** to form the diaphragm.

Figure 2:
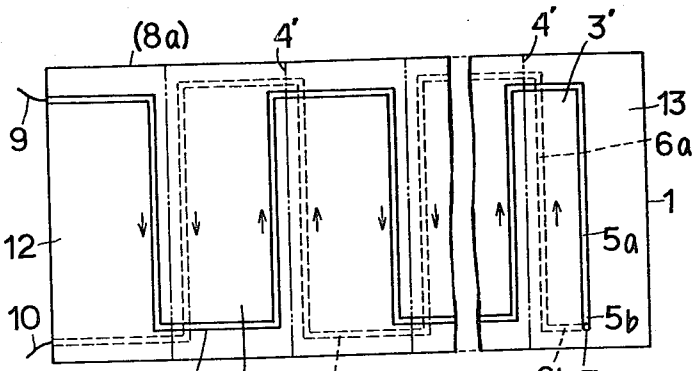
FIG. 2 is an expansion plan, partially cut away, of the diaphragm of another type which is applicable to the acoustic transducer according to the present invention.
Figure 1:
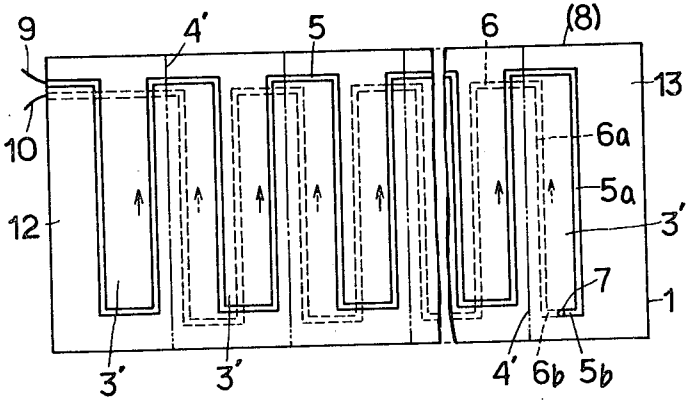
FIG. 1 is an expansion plan, partially cut away, of the diaphragm applicable to the acoustic transducer according to the present invention.

Reference will now be made to FIG. 2 that is a partially cut away expansion plan showing another type of the rectangular diaphragm applicable to the loudspeaker according to the present invention. The diaphragm illustrated comprises a thin film member 1 formed of a material similar to the thin film member 1 for diaphragm 8 of FIG. 1, which is formed into a given shape after it has been provided on its both surfaces with meandering wire gauge conductors. A continuous, meandering wire gauge conductor 5 is formed on portions 4' of the surface of the thin film member 1 which will provide trough portions 4 in the arcuate corrugations 2 upon shaping of the thin film member 1, and a similar conductor 6 is formed on the rear surface thereof in a different pitch phase. A terminal **5*b* of an extreme conductor 5*a* on portion 3' which will provide a peak portion in the arcuate corrugation 2 is electrically connected with a terminal 6*b* of an extreme conductor 6*a* cn portion 4' which will provide a trough portion in the arcuate corrugation 2 by an eyelet or other suitable means, whereby the conductor 5 is connected in series with the conductor 6. Such a thin film member is corrugated by suitable means to form a number of elongate, arcuate corrugations 2 which serve as a diaphragm 8*a*. Sound currents flow alternately through the conductors 5 and 6 on the respective trough portions 4 of diaphragm 8*a* in the opposite direction, but the conductor 5*a* is not affected by the magnetic fluxes caused by the permanent magnets to be described later. Reference numerals 9 and 10 are lead wires. The conductors 5 and 6 may be provided by known means including printing and deposition. Only one of the conductors 5 and 6 may be applied on the thin film member 1 to form the diaphragm. The height of each arcuate corrugation 2 is on the order of 5 to 20 mm, and the spacing between adjacent trough portions 4 is on the order of 5 to 15 mm. In one of diaphragms 8 and 8*a*, the height of the arcuate corrugations 2 and the spacing between adjacent trough portions 4** are kept constant.

Figure 3:
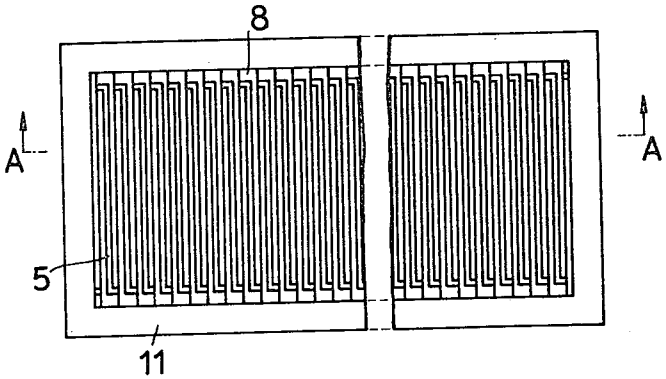
FIG. 3 is a plan view, partially cut away, of the acoustic transducer according to the present invention.
Figure 4:
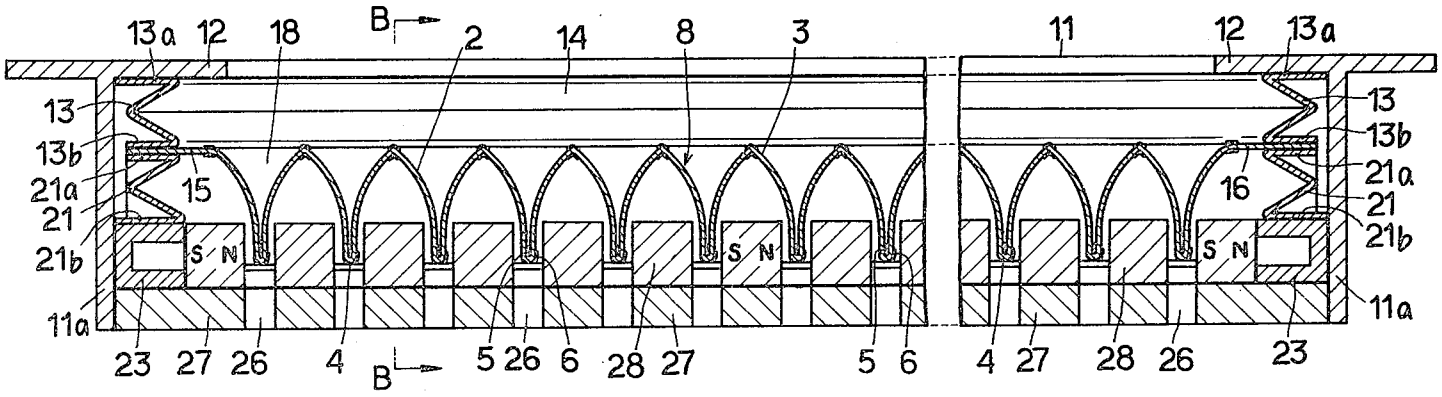
FIG. 4 is an enlarged section view which is partially cut away and taken along A—A line of FIG. 3.

Reference will now be made to FIG. 3 being a partially cut away plan view of the loudspeaker which is one embodiment of the acoustic transducer according to the present invention; FIG. 4 being an enlarged section which is partially cut away and taken along line A—A of FIG. 3; and FIG. 5 being a partially cut away section on line B—B of FIG. 4.

A frame member 11 for this loudspeaker may integrally be formed of a non-magnetic material such as aluminum or synthetic resin, or parts thereof may be assembled together by virtue of suitable fixing means including adhesives, screws etc. With the aid of suitable fixing means such as a bonding agent, the edge parts 12 of the frame member 11 are fixedly provided on its inner surface with tongue pieces **13*a* and 14*a* of resilient support members 13 and 14 which are lengthwise corniced. Other tongue pieces 13*b* of the resilient support member 13 are secured to support portions 15 and 16 on both sides of diaphragm 8 as by adhesives. Both end surfaces extending perpendicularly to the arcuate corrugations 2 of diaphragm 8 are fixedly provided along their length with L-shaped support members 17 and 18 as by adhesives, which support members are formed of a light and non-magnetic material such as aluminum or titanium and is made thin within such an extent that they undergo no deformation due to the vibrations of diaphragm 8. The lower tongue pieces 14*b* of another pair of resilient support members 14 are secured to the upper surfaces of projecting plates 19 and 20 as by adhesives. Upper tongue pieces 21*a* and 22*a* of corniced resilient support members 21 and 22 which are also formed of and to the same material and shape as those of said resilient support members 13 and 14 are secured to the rear surfaces of the support portions 15, 16 and support plates 17, 18 for diaphragm 8 as by adhesives. Lower tongue pieces 21*b* and 22*b* of the resilient support members 21 and 22 are also secured as by adhesives to the upper surfaces of support frames 23 which are fixed as by screws to the lower inner peripheries of side walls 11*a* of the frame member 11. The length of the resilient support members 13, 14 is equal to the width of the support portions 15, 16 for diaphragm 8, and the length of other resilient support members 13, 14 are equal to the length of the projecting plates 19, 20 for the support plates 17, 18. The joint portions of the ends of the resilient support members 13, 14 and 21, 22** should be free from any voids.

As the materials for said corniced resilient support members 13, 14, 21 and 22, use may be made of Japanese paper, cloth or nonwoven fabric having a thickness on the order of 10 to 70 microns which is impregnated with silicone rubber paint, but preference is given to a thin plate of metallic titanium having a thickness of about 10 to 50 microns or an about 10 to 200 microns thick plastic film made of, e.g., polyester, polypropylene, polyethylene and nylon since they excel in durability, restorability and workability. In view of assembling and manufacturing of the resilient support members 13, 14, 21 and 22, it is preferred that the upper projecting plates 12, 20 are made flush with the support portions on both sides of the diaphragm.

Support rods 24, 25 formed of, e.g., aluminum or synthetic resin are secured as by screws to both sides of the lower ends of the side walls **11*a* of the frame member 11 which extend perpendicularly with respect to the arcuate corrugations 2 of diaphragm 8. A number of magnet-supporting rods 27 formed of for instance aluminum, synthetic resin or other similar material are pendulously provided at predetermined intervals 26 between the support rods 24 and 25, and are fixed thereto as by screws. One or plural rod-like permanent magnets, preferably ferrite permanent magnets 28 having a length equal or substantially equal to that between adjacent trough portions 4 of diaphragm 8 are fixed as by screws or adhesives onto each magnet-supporting rod 27*b* between adjacent trough portions 4. The conductors 5, 6 on each trough portion 4 are then arranged at the center or the substantially central portion of each permanent magnet 28, and the permanent magnets 28 are arranged so as to produce magnetic fluxes in the same direction therebetween. More specifically, the permanent magnets 28 are magnetized with the same polarity on one sides, while they are magnetized with the opposite polarity on the other sides. The permanent magnets 28 should preferably be brought in proximity to the trough portions 4** as much as possible to such an extent that they do not come into contact with diaphragm 8 at the time of the maximum vibration or excursion thereof.

In the case of using the diaphragm 8*a* of FIG. 2, it is required that the permanent magnets be arranged on both sides of each trough portion 4 such as to alternately cause magnetic fluxes in the opposite directions, since sound currents flow alternately through the conductors 5 and 6 on each trough portion 4 in the opposite directions.

Application of sound currents to lead wires 9, 10 of the loudspeaker according to the present invention assures that the diaphragm 8 vibrates over its entire surface by the sound currents flowing through the conductors 5, 6 on each trough portion 4 and the magnetic fluxes caused by the permanent magnets 28 in accordance with Fleming's left-hand rule to reproduce the sound currents. Since the diaphragm 8 comprises a multiplicity of the arcuate corrugations obtained by corrugating the thin film member and the entire periphery of diaphragm 8 is supported from its both surfaces with the resilient support members 13, 14, 21 and 22 corniced by folding, the diaphragm 8 causes no lateral vibration, thus resulting in sound reproduction free from any distortion. In addition, this assures that the diaphragm 8 vibrates uniformly over its entire surface in the same phase, thus leading to faithful sound reproduction especially with respect to a low sound frequency range of a great amplitude without causing partial deformation of diaphragm 8 due to inertia and the air pressure generated by the vertical vibrations of diaphragm 8 and causing partial deformation of diaphragm 8 such as restoration of the deformed portion due to decreases in the air resistance and the elasticity of diaphragm 8 at the lower and upper limits of vibrations. The sound generated by diaphragm 8 is a plane wave and hence of more or less directivity, which results in less attenuation over a relatively long distance. Furthermore, since the interior of the frame member 11 is divided into two portions by the diaphragm 8, the resilient support members 13, 14, 21 and 22, and the support plates 17, 18 and there is no connection between the front and rear surfaces of diaphragm 8, the sound generated on the rear surface of diaphragm 8 does not reach the front surface of diaphragm 8 in the frame member 11. This causes no distortion to be introduced in the sound. Moreover, since the loudspeaker has a thickness of 20 to 50 mm, it can easily be mounted to the ceiling and wall. In addition, this loudspeaker can readily be incorporated into a radio or other similar equipment without the need of any large, low sound speaker box which is heretofore required.

Figure 6:
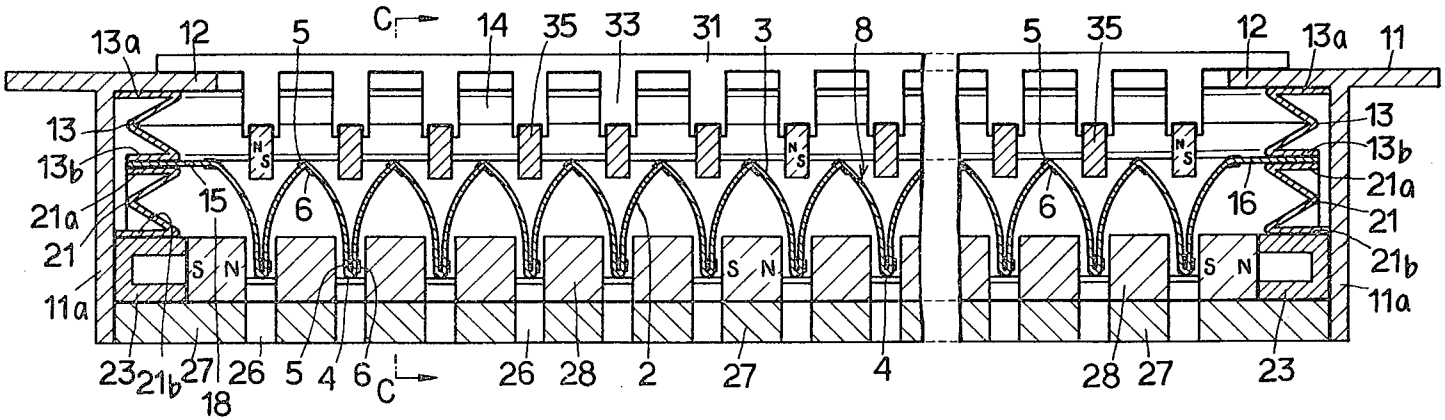
FIG. 6 is a sectional view, partially cut away, of the acoustic transducer of another type.

Reference will be made to FIG. 6 being a partially cut away section illustrative of the loudspeaker which is another embodiment of the transducer according to the present invention; and FIG. 7 a being a partially cut away section on line C—C of FIG. 6.

Figure 5:
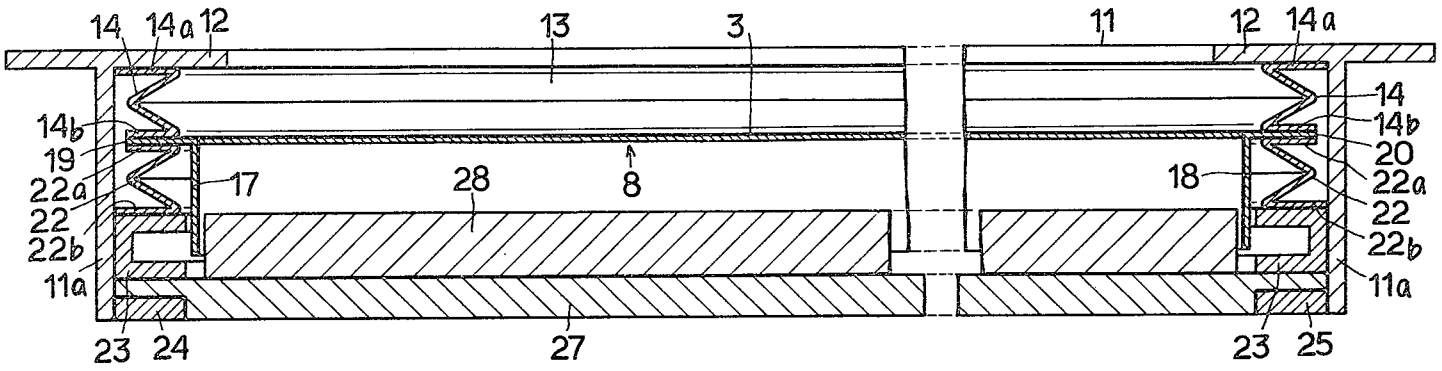
FIG. 5 is a sectional view which is partially cut away and taken along line B—B of FIG. 4.
Figure 7:
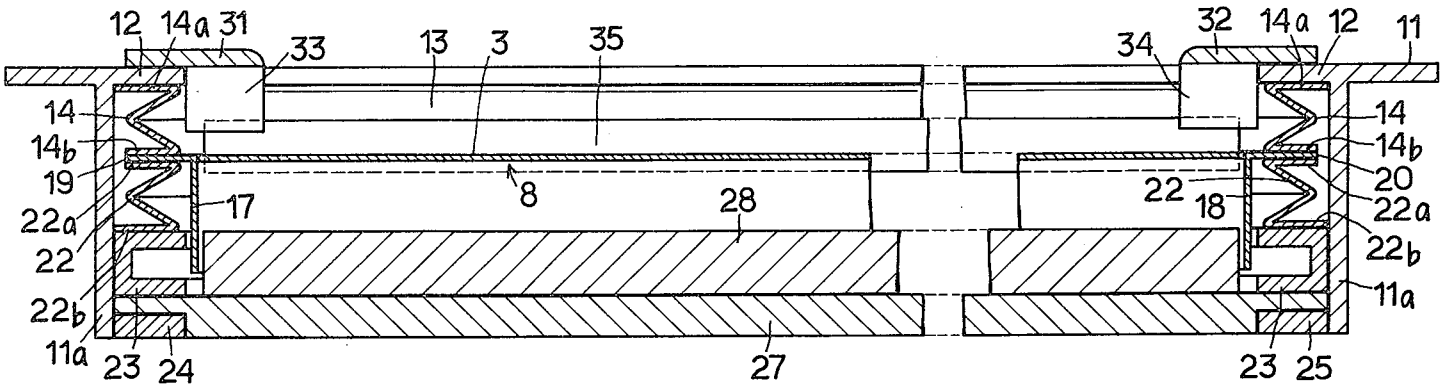
FIG. 7 is a sectional view which is partially cut away and taken along line C—C of FIG. 6.

The loudspeaker shown in FIGS. 6 and 7 is designed to further increase the efficiency of sound reproduction by providing the diaphragm 8 used in the loudspeaker of FIGS. 4 and 5 with permanent magnets which produce magnetic fluxes acting on the conductors 5, 6 applied on the peak portions 3 of the arcuate corrugations 2 such that the diaphragm 8 is intensively driven.

Both edge parts 12 extending perpendicularly with respect to the arcuate corrugations 2 are fixedly provided as by screws with retaining members 31, 32 which are in turn provided on their undersurfaces with magnet-mounting portions 33, 34 between the respective peak portions in the arcuate corrugations 2 of diaphragm 8. The ends of rod-like permanent magnets 35 are fixed to the magnet-mounting portions 33, 34 as by screws or adhesives such that the conductors 5, 6 on each peak portion 3 in each arcuate corrugation 2 of diaphragm 8 are positioned at the center or the substantially central portion between the respective permanent magnets 35. In this connection, the poles of the permanent magnets 35 should be set according to Fleming's left-hand rule such that the driving forces of conductors 5, 6 are kept constant, and that the driving forces of conductors 5, 6 on trough portions 4 caused by the lower permanent magnets 28 are in the same direction for the operation of diaphragm 8. As shown in FIG. 6 as an example, the upper permanent magnets 35 are magnetized opposite in polarity to the lower magnets 28 whereby the driving forces of the conductors 5, 6 on the peak and trough portions 3 and 4 of the arcuate corrugations 2 are in the same direction.

No detailed description is here given with respect to the parts or members shown at the same reference numerals as those of FIGS. 4 and 5 for the purpose of simplicity.

The loudspeaker as described just above has not only numerous advantages presented by the loudspeaker of FIGS. 4 and 5 but also an additional advantage in that the diaphragm 8 is also driven by the conductors 5, 6 applied on the peak portions 3 of the arcuate corrugations by way of the permanent magnets 35 mounted on the upper portion of diaphragm 8, thereby further increasing the efficiency of sound reproduction.

Figure 8:
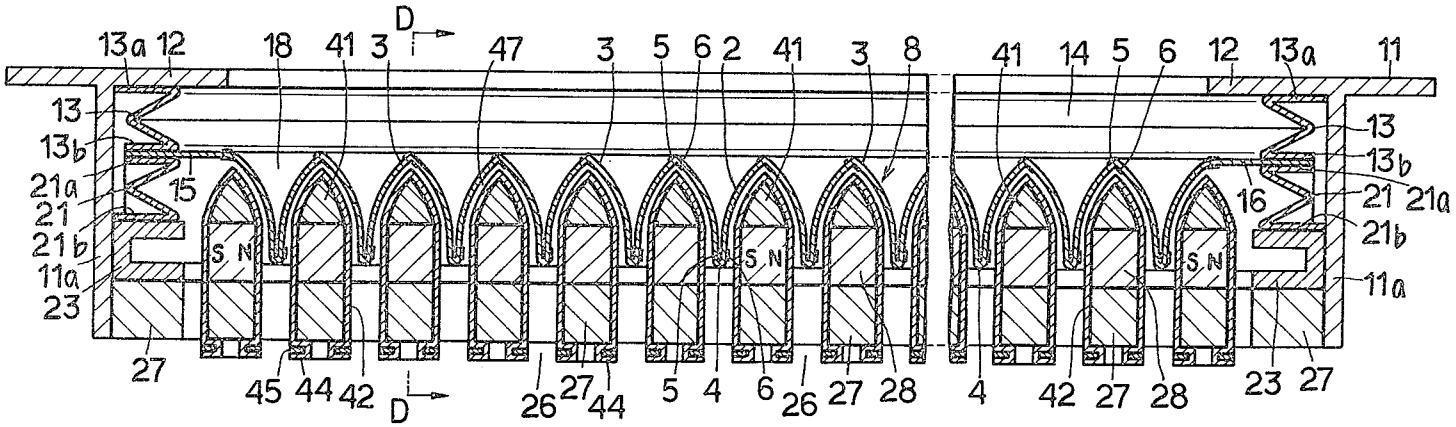
FIG. 8 is a sectional view, partially cut away, of the transducer of still another type.
Figure 9:
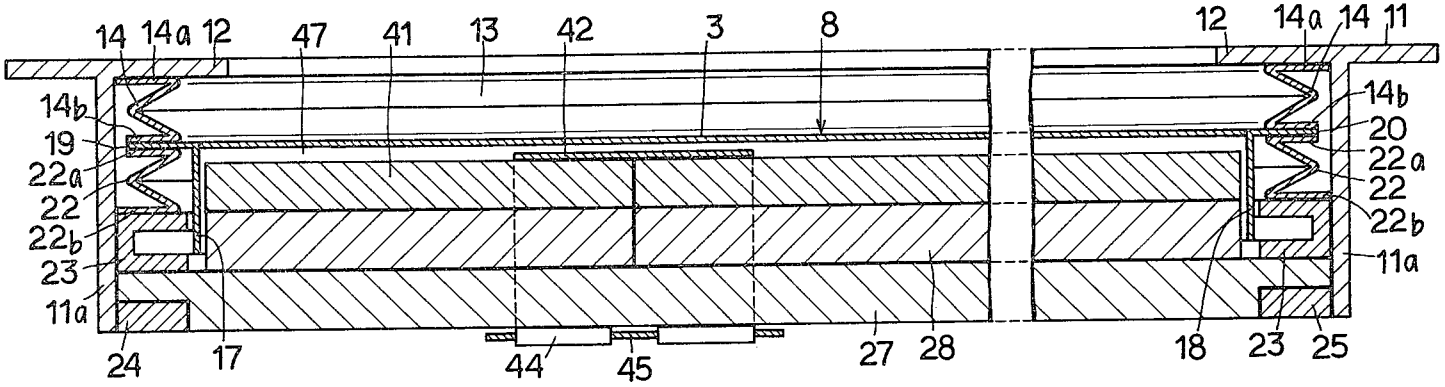
FIG. 9 is a sectional view which is partially cut away and taken along line D—D of FIG. 8.
Figure 11:
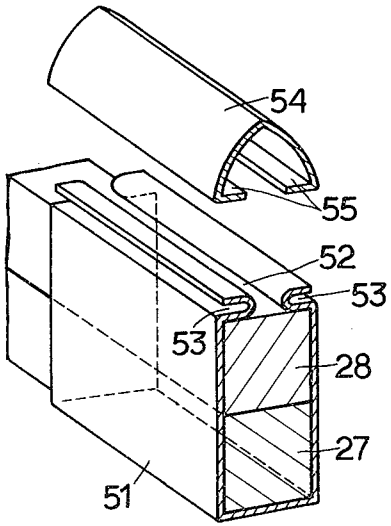
FIG. 11 is an enlarged, exploded perspective view showing another embodiment of the fixing member.
Figure 10:
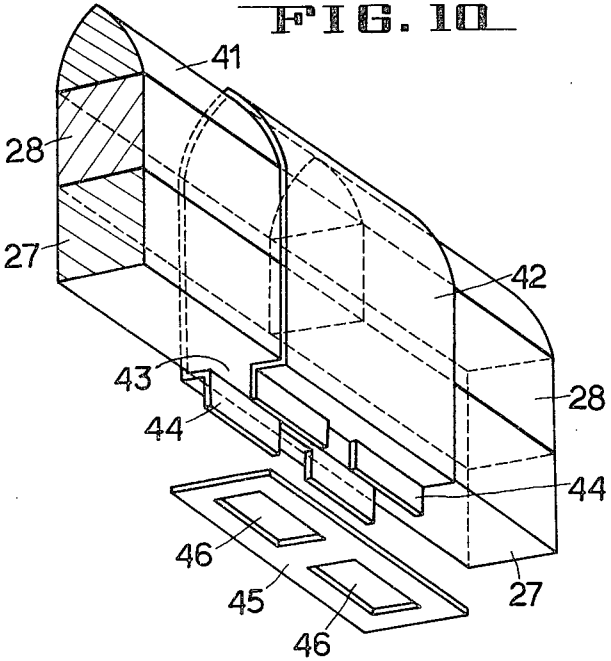
FIG. 10 is an enlarged, exploded perspective view illustrative of a fixing member.

FIG. 8 is a partially cut away section illustrative of the loudspeaker which is still another embodiment of the transducer according to the present invention; FIG. 9 is a partial cut away section on line D—D of FIG. 8; and FIGS. 10 and 11 are exploded perspective views of two types of fixing means.

The loudspeaker shown in FIGS. 8 and 9 is designed to decrease the back resistance of diaphragm 8, prevent the diaphragm 8 from resonating with the frame member 11 being a fixing member, magnet-supporting rods 27 and permanent magnets 28 and eliminate any subharmonic distortion by spacing projecting members from the inner surfaces of the arcuate corrugations 2 over the length of the upper surfaces of permanent magnets 28 incorporated into the loudspeaker of FIGS. 4 and 5, thereby obtaining the reproduced sound of good quality.

As the projecting members 41 use is made of a non-magnetic material such as aluminium or synthetic resin having a shape in cross-section similar to the arcuate corrugations 2 of diaphragm 8 or analogous to a semi-elliptic, semi-circular or triangular shape. The projecting members are bonded as by adhesives to the upper surfaces of the lower permanent magnets 28 of diaphragm 8 along their length. Fixing bodies 42 comprising thin plates formed of a non-magnetic metal such as aluminium or titanium and having an upper portion shaped to be fit to the projecting members 41 are designed to fixedly enclose therein the projecting members 41, permanent magnets 28 and magnet-supporting rods 27. Projecting pieces 44 provided on both side edges of an opening portion 43 of the fixing body 42 are inserted into through-windows 46 provided in a stop plate 45 composed of a suitable material and the stop plate 45 is fixed in place by folding said projecting pieces 44 outwardly, so that the projecting members 41, permanent magnet 28 and magnet-supporting rod 27 are fixed together. Previous application of adhesives on the inner surface of the fixing body 42 will lead to increases in the fixing strength. When use is made of a plurality of projecting members 41 connected with permanent magnets 28, it is preferred that the fixing body 42 be mounted on the joint portion of these members. Preferably, the spacing between the projecting members and the inner surface of the arcuate corrugation 2 may be made small within such an extent the members 41 are not brought into contact with the fixing body 42.

No detailed description is here given with respect to the parts and members shown at the same reference numerals as those of FIGS. 4 and 5 for the purpose of simplicity.

The loudspeaker as described just above has not only numerous advantages presented by that of FIGS. 4 and 5 but also an additional advantage in that the back resistance of diaphragm 8 is decreased so as to prevent the resonance of diaphragm 8 with the fixing members and generation of subharmonic distortion thereby obtaining the reproduced sound of good quality. This is achieved by forming the projecting members 41 over the entire length of the permanent magnets 28 such that they are spaced at given intervals 47 from the inner surfaces of the arcuate corrugations 2.

Referring to FIG. 11 showing another type of the fixing means 3 for forming the projecting members, fixing bodies 51 composed of thin plates of a non-magnetic material such as aluminium or titanium are designed to fixedly enclose therein the permanent magnets 28 and the magnet-supporting rods 27 over their entire length. Stop grooves 53 are formed on the outside of an upper opening portion 52 of the fixing body 51 along the entire length of its both sides. A projecting member 54 formed of a thin plate of such a non-magnetic material as mentioned hereinbefore, which member has a shape in cross-section similar to the arcuate corrugation 2 of diaphragm 8 or analogous to a semi-elliptic, semicircular or triangular shape and is spaced from the inner surface of the arcuate corrugation 2, is used. Lower end edges of both sides of the projecting member are folded inwardly to form a pair of folded pieces 55 which are in turn inserted into said stop grooves 53. As a result, the projecting member 54 is fixed to the fixing body 51 and the permanent magnet 28 secured to the magnet-supporting rod 27. The loudspeaker having the projecting portion formed by the projecting member 54 provided on the entire surface of the permanent magnet 28 has an advantage similar to that of the loudspeaker of FIGS. 8 and 9.

Figure 13:
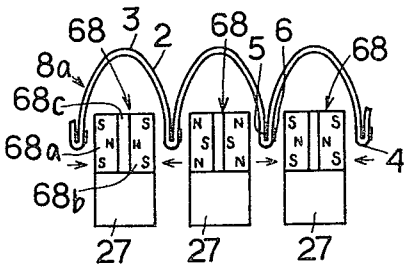
FIG. 13 is a partial front view showing the relation between the position of still another type of the transducer and that of the permanent magnets.
Figure 12:
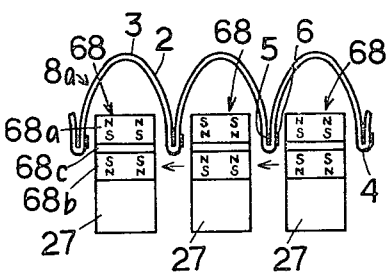
FIG. 12 is a partially front view showing the relation between the position of another type of the diaphragm and that of permanent magnets.

Reference will now be made to FIGS. 12 and 13 showing the relation between the diaphragm 8*a*, the magnet-supporting rods 27 and the permanent magnets 68 in the case of using the diaphragm 8*a* of FIG. 2. No conductors through which sound current flow are provided on the peak portions in the arcuate corrugations of diaphragm 8*a*, and sound currents flow alternately through the conductors 5, 6 on each trough portion 4 in the opposite directions. Accordingly, it is required that the permanent magnets 68 on the magnet-supporting rods 27 have their N and S poles arranged such that the magnetic fluxes produced are alternately in the opposite directions. For example, through a non-magnetic thin plate 68 formed of, e.g., aluminium, copper or synthetic resin rod-like permanent magnet pieces 68*a* and 68*b* are bonded together by adhesives with their N poles confronting each other and their S poles facing each other. The thus obtained two rod-like magnets 68 are arranged with their bonded surfaces positioned in the lateral or longitudinal direction. Thus, the magnets having bonded surfaces serving as N poles and bonded surfaces serving as S poles are alternately fixed to the magnet-supporting rods 27. The advantages of the loudspeaker comprising a combination of the diaphragm 8*a* and permanent magnets 68 are similar to those of the loudspeaker of FIGS. 4 and 5. The combination of the diaphragm 8*a* and permanent magnets 68 may also be introduced into the loudspeaker of FIGS. 6 and 7 or 8 and 9 as the case of the combination of the diaphragm 8 and permanent magnets 28.

What is claimed is:

1. An acoustic transducer which includes a rectangular, thin film member which is corrugated to form a number of elongate, arcuate corrugations wherein conductors are applied in series relation on at least one surface of each trough portion and each peak portion between adjacent arcuate corrugations such that sound currents flow through the conductors on each trough portion in the same direction while the sound currents flow through the conductors on each peak portion in the opposite direction to those flowing through each trough portion, and in which rod-like permanent magnets extending parallel to the conductors on each trough portion and generating magnetic fluxes in the same direction are retained over the substantially entire length between adjacent trough portions and both surfaces of each side edge of the diaphragm are supported by support members which are expandable and contractable only in the direction extending perpendicularly to the diaphragm.

2. An acoustic transducer as claimed in claim 1, in which over the substantially entire length between adjacent peak portions are retained rod-like permanent magnets extending parallel to the conductors formed on the peak portion of each arcuate corrugation and generating magnetic fluxes in the direction opposite to those caused by the rod-like permanent magnets provided between adjacent trough portions.

3. An acoustic transducer which includes a rectangular, thin film member which is corrugated to form a number of elongate, arcuate corrugations wherein conductors are applied in series relation on at least one surface of each trough portion of adjacent arcuate corrugations such that sound currents flow alternately through the conductors in opposite directions, and in which rod-like permanent magnets extending parallel to the conductors on each trough portion and alternately generating magnetic fluxes in opposite directions are retained over the substantially entire length between adjacent trough portions, and both surfaces of each side edge of the diaphragm are supported by support members which are expandable and contractable only in the direction extending perpendicularly to the diaphragm.

4. An acoustic transducer as claimed in claim 3, in which pairs of the rod-like permanent magnets are bonded together via an intermediate layer of a non-magnetic material to form (i) a first set with their S poles confronting each other and (ii) a second set with their N poles confronting each other, the pairs of each set having the bonded surfaces thereof positioned in the lateral or longitudinal direction, and the permanent magnet pairs of the first set being interleaved with the permanent magnet pairs of the second set over substantially the entire length of adjacent trough portions in the diaphragm.

5. An acoustic transducer as claimed in claim 1 or 3, in which support plates are fixedly bonded to both end surfaces of the diaphragm extending perpendicularly to the arcuate corrugations, and both surfaces of the diaphragm projecting from said support plates and both surfaces of the support portions of both sides of the diaphragm parallel to the arcuate corrugations are corniced lengthwise and are supported by support members which are expandable and contractable only in the direction extending perpendicularly to the diaphragm.

6. An acoustic transducer as claimed in claim 5, in which said support plates are formed of a thin, non-magnetic material which is designed to undergo no deformation due to the vibrations of the diaphragm.

7. An acoustic transducer as claimed in claim 5, in which said support plates are formed of a fiberous sheet having a thickness on the order of 10 to 70 microns and impregnated with silicone rubber paint, and a thin plate having a thickness on the order of 10 to 200 microns.

8. An acoustic transducer as claimed in claim 1 or 3, in which projecting portions having a shape in cross-section similar to the arcuate corrugations or analogous to a semi-elliptic, semi-circular or triangular configuration are spaced from the inner surfaces of the arcuate corrugations over the entire length of the upper surfaces of the rod-like permanent magnets retained between adjacent trough portions in the diaphragm, and corresponding projecting members forming part of each of said projecting portions.

9. An acoustic transducer as claimed in claim 8, further comprising rods for supporting said permanent magnets, an array of fixing bodies having an upper surface to be fitted to said projecting members and arranged to fixedly enclose therein the projecting members, the rod-like permanent magnets and the magnet-supporting rods, and projecting pieces provided on both side edges of an opening portion bored in the undersurface of said fixing bodies are inserted into through-windows in stop plates such that the projecting pieces are fixed to said stop plates by their outward folding.

10. An acoustic transducer as claimed in claim 8, further comprising rods for supporting said permanent magnets, and lower end edges on both sides of the projecting members forming part of said projecting portions, said lower end edges being respectively inwardly folded to form folded pieces, stop grooves are formed on the outside of the fixing bodies enclosing the rod-like permanent magnets and magnet-supporting rods along their entire length and over the entire length of both sides of an opening portion bored in the upper surface thereof, and said folding pieces are inserted into said stop grooves to secure the projecting members to said fixing bodies.

11. An acoustic transducer as claimed in claim 9, in which said projecting members, fixing bodies and stop plates are formed of a non-magnetic material such as synthetic resin, aluminium or metallic titanium.

12. An acoustic transducer according to claim 7, wherein said plate comprises metallic titanium and has a thickness on the order of 10 to 50 microns.

13. An acoustic transducer according to claim 7, wherein said plate comprises a synthetic resin film and has a thickness on the order of 10 to 200 microns.

14. An acoustic transducer according to claim 13, wherein said synthetic resin comprises a polyester, polypropylene, polyethylene or nylon.

* * * * *